US006418894B1

(12) United States Patent
Haas et al.

(10) Patent No.: US 6,418,894 B1
(45) Date of Patent: Jul. 16, 2002

(54) ENGAGING AND DISENGAGING SUPPORT ELEMENT

(75) Inventors: Michael Haas, Weisendorf; Joachim Seitz, Reundorf, both of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/702,157

(22) Filed: Oct. 30, 2000

(30) Foreign Application Priority Data

Nov. 3, 1999 (DE) ..... 199 52 909

(51) Int. Cl.[7] ..... F01L 1/34

(52) U.S. Cl. ..... 123/90.16; 123/90.41; 123/198 F; 123/90.15; 123/90.39

(58) Field of Search ..... 123/90.16, 90.12, 123/90.15, 90.39, 90.41, 90.43, 90.44, 90.46, 90.61, 198 F

(56) References Cited

U.S. PATENT DOCUMENTS 4,151,817 A * 5/1979 Mueller ..... 123/90.16
4,442,806 A * 4/1984 Matsuura et al. ..... 123/198 F
4,481,919 A 11/1984 Honda et al.
4,515,121 A * 5/1985 Matsuura et al. ..... 123/198 F
4,762,096 A * 8/1988 Kamm et al. ..... 123/90.16
4,836,162 A * 6/1989 Melde-Tuczai et al. .. 123/90.16
5,655,487 A * 8/1997 Maas et al. ..... 123/90.16
5,720,244 A * 2/1998 Faria ..... 123/90.16
5,832,884 A * 11/1998 Haas et al. ..... 123/90.16
5,875,748 A * 3/1999 Haas et al. ..... 123/90.16
5,960,756 A * 10/1999 Miyachi et al. ..... 123/90.16

FOREIGN PATENT DOCUMENTS

DE 4323555 A1 1/1995
DE 19500575 A1 7/1996
DE 19604866 A1 8/1997
FR 2674287 9/1992

* cited by examiner

*Primary Examiner*—Mark Paschall
*Assistant Examiner*—Fadi H. Dahbour
(74) *Attorney, Agent, or Firm*—Volpe and Koenig, P.C.

(57) ABSTRACT

An engaging and disengaging support element is proposed, having a compression spring (21) constructed as a so-called "lost-motion spring" that concentrically surrounds an inner element (5) that can be uncoupled. Because of this construction, a considerable amount of construction space is gained in the axial direction. Preferably, the support element (1) is provided with a hydraulic play compensation element (9).

14 Claims, 1 Drawing Sheet

ENGAGING AND DISENGAGING SUPPORT ELEMENT

BACKGROUND

The invention relates to an engaging and disengaging support element, in particular for a finger lever of a valve drive of an internal combustion engine. The support element includes a hollow cylindrical housing arranged with a first facing side in a receptacle of a cylinder head, whereby in the bore of the housing an axially movable inner element travels, which is spring-loaded against the housing via at least one compression spring. The inner element includes a head that projects beyond a second facing side of the housing, and the finger lever can be set on this head. The housing and the inner element each have at least one bore hole. These bore holes are aligned with each other in an axial displacement of the inner element to a furthest position from the first facing side, where in at least one of the bore holes, a coupling piston runs, which can be displaced sectionally into the other bore hole so that the inner element is connected to the housing.

A support element of this type is known from WO 95/16851, FIG. 5, which is considered to be the generic concept. This has an inherent disadvantage that it is built relatively high. As the expert can gather from the figure, there is a considerable space requirement due to the compression spring being positioned below the inner element. Should a support element of this type, for example, be implemented in existing engine designs, then construction space problems could result because of its relatively large height. Also, it is often not possible to drill the receptacle deeper for the support element in the cylinder head, since it would enter into the area, for example, for intake, outlet or cooling channels or the like.

The object of the invention is thus to create a support element of the type described above in which the cited disadvantages can be eliminated with simple mechanisms.

SUMMARY OF THE INVENTION

This object is achieved according to the invention in that the compression spring, at least for the most part, completely concentrically surrounds the inner element.

By this "nested" construction method, considerable building space can be gained in the axial direction. In the present practice, this means a building space gain of 10 to 20 millimeters. The support element proposed according to the invention can thus for the most part be integrated afterwards into existing engine designs. Costly changes to the base design are therefore unnecessary.

An especially thin-walled construction of the essential structural parts of the support element is proposed. Due to this, it has on the one hand, only a very small weight. On the other hand, it has a relatively small width.

In realizing the invention, it is proposed to place the compression spring on one end against a spring plate in the area of the head of the support element, and on the other end, to let it act against a separate ring support, which is attached to the housing on the outside. Thus, the compression spring advantageously encloses, also partially, an outer sheath of the housing. As a compression spring, mainly a screw type and namely, a spiral spring, come into consideration. It is also conceivable that several compression springs that are nested into each other can be used.

The spring plate should preferably be manufactured as a thin-walled sheet metal part, for which only small manufacturing costs are necessary. It is furthermore provided that this spring plate is guided on its outer edge in the receptacle of the cylinder head. By this guide and also by the guide of the ring support radially outwardly in a corresponding receptacle of the cylinder head, the transverse forces introduced by the finger lever into the pressure piston can be efficiently transmitted and supported. The finger lever according to the invention has, for this purpose, a sufficient guide length in the cylinder head.

An especially advantageous embodiment of the guide for the spring plate is the object of an additional claim. According to the claim, the spring plate should make a transition on its outer edge into a ring collar, which passes directly in the corresponding receptacle. The ring collar can extend, depending on the constructive embodiment of the support element, in the direction to the receptacle or away from it. In addition, it can have a T-profile.

It is also proposed to construct the ring collar as a single piece with the pressure piston. For this, manufacturing processes such as metal powder injection molding and the like are suitable. It is, however, also proposed according to the invention to firmly affix the ring collar or the ring support using a connection method that is known, such as welding, soldering, clipping, snapping or pressing it in or onto the inner element or the housing. Also, separate elements, such as, for example, securing rings for affixing the position can be provided.

In particular for the case that the support element according to the invention should be installed into an aluminum cylinder head, it is proposed in making the invention more defined to provide the receptacle in the area of the outer edge of the spring plate with suitable wear protection methods. Here in particular, a separate and wear-proof insert piece such as a ring is considered, which however, can also be made to provide the receiving area, for example, with a separate wear protection layer, among other things.

Preferably, the structural parts of the inner element, housing, spring plate, and ring support, or at least one of these structural parts, should be made from a deep-drawn sheet metal material or an otherwise thin-walled metal material or lightweight material manufactured by a non-cutting process. These measures have an excellent effect on the manufacturing costs and reduce the mass of the support element as mentioned. In this manner, the ring support can be positioned at a height of the hole in the housing for the coupling piston. Thus, the ring support can be used as a radial extension of the bore of the housing for the coupling piston.

It is proposed that the coupling piston extends completely in the bore of the inner element in its uncoupled position and when coupled, can be displaced sectionally into the bore of the housing, and thus also into the connection bore of the ring support. Of course, a solution is also provided in which the piston runs radially outwardly in the bore of the housing during uncoupling and during coupling, and it can be displaced sectionally radially inwardly into the bore of the inner element. This shift occurs in a known way in at least one extension direction via a hydraulic medium. Preferably, a return movement against the hydraulic medium pressure can be managed via the compression spring force.

An especially preferred embodiment of the invention results if a hydraulic play compensation element is integrated into the inner element. This play compensation element is positioned axially above the bore for the coupling piston and has a preferably separately constructed path to the supply of hydraulic medium compared to the path for the supply of hydraulic medium to the coupling piston.

Included in the protective scope of the invention is also a solution in which the finger lever is set in bearings on the housing, and the inner element arranged in the housing is supported against the cylinder head.

BRIEF DESCRIPTION OF THE DRAWINGS

The invention is explained in greater detail in connection with the drawings. In the drawings.

DETAILED DESCRIPTION OF THE DRAWINGS

Figure 1:
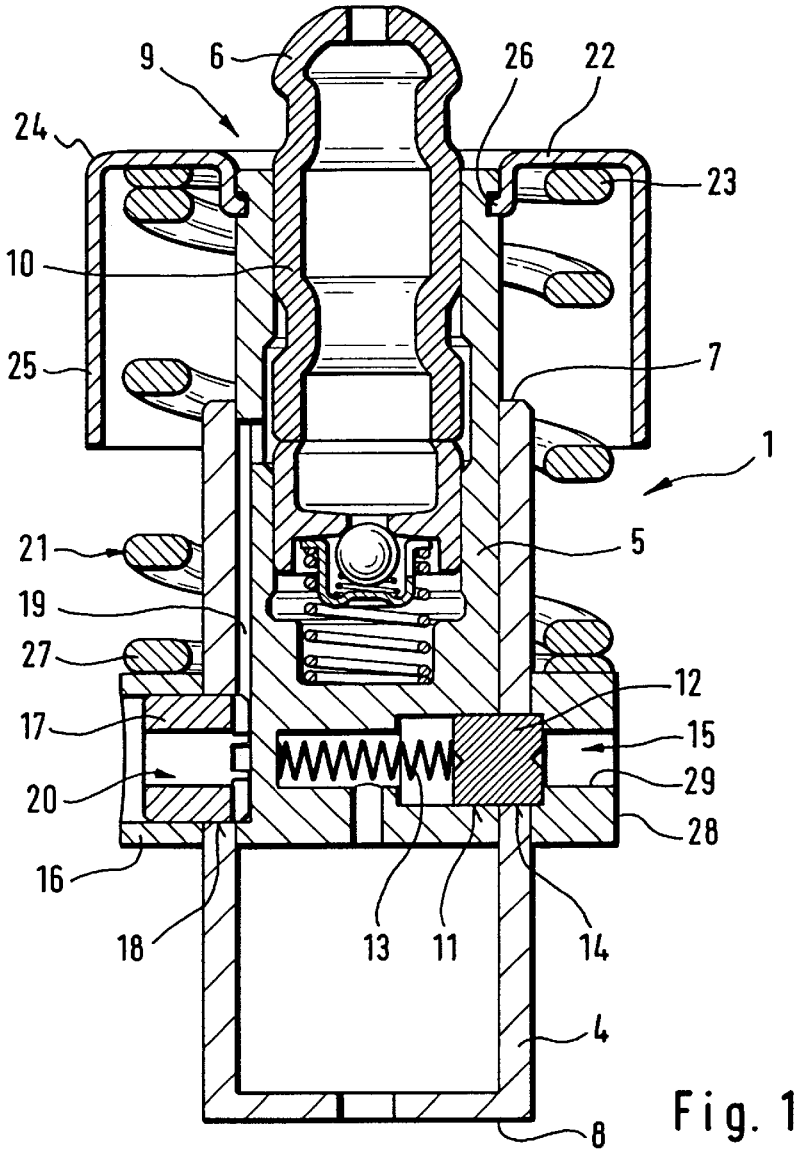
FIG. 1 is a sectional view through a support element according to the invention.
Figure 2:
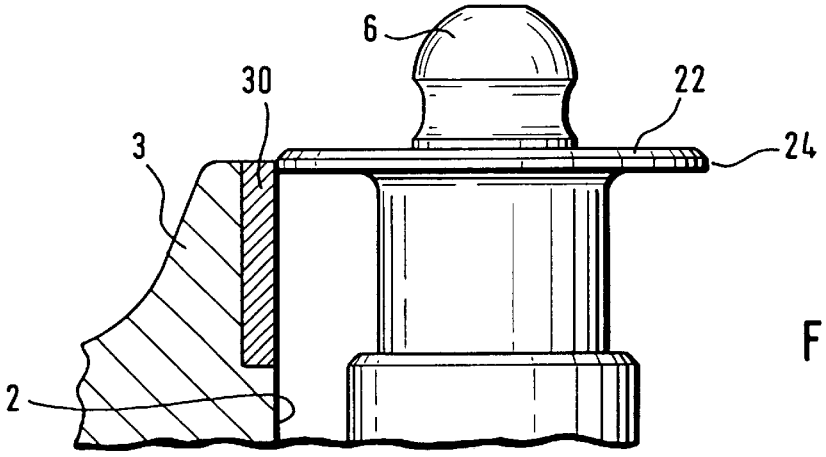
FIG. 2 is a support element in the area of the head with a washer-type spring plate.

FIG. 1 discloses a support element 1 according to the invention. It can, as indicated in FIG. 2, be installed in a receptacle 2 of a cylinder head 3.

The support element 1 includes essentially a hollow cylindrical housing 4, having a bore in which an inner element 5 is axially inserted.

The inner element 5 has a head 6 extending away from the bore. On this head 6, an end of a finger lever (not shown in the drawing) is supported.

The head 6 projects beyond a second facing side 7 of the housing 4 at least to a small extent. Furthermore, the housing 4 has a first facing side 8. It is designed so that it is closed and extends into the receptacle 2. It can, however, of course, also be manufactured in an open circular ring shape. A hydraulic play compensation element 9 known from the prior art is integrated into the inner element 5. The head 6 is a component of a pressure piston 10 of the play compensation element 9, which includes hydraulic medium.

Axially below the play compensation element 9, the inner element 5 has a radially extending bore 11. In this bore 11, a coupling piston 12 is seated. This coupling piston 12 is biased radially outwardly via the force of a compression spring 13. A bore 14 in the housing 4 is aligned with the bore 11 in the axial displacement position shown here, from the inner element 5 to the housing 4. Thus, the inner element 5 and the housing 4 are coupled to each other physically. The finger lever lying on the head 6 pivots in a customary manner. A gas exchange valve that is acted on by the finger lever completes a normal stroke.

A return movement of the coupling piston 12 is provided in the direction to the bore 11 via the hydraulic medium. This medium can be supplied via a separate path 15, which is installed in a ring support 16 to be explained later. This ring support 16 is thus positioned at the level of the coupling piston 12.

Diametrically opposed to the coupling piston 12, a locking piston 17 is applied. This locking piston can, however, of course also be arranged at another height section of the support element 1. The locking piston 17 is also manufactured as a piston. It runs radially outwardly in the ring support 16 and extends through an opening 18 in the housing 4 in a longitudinal groove 19 on the inner element 5.

As the skilled artisan can also ascertain from FIG. 1, in the locking piston 17, an additional path 20 is provided. This path 20 functions as a separate supply of hydraulic medium to the play compensation element 9 in a known way. To the skilled artisan it is clear that this path 20 can also be conducted to any other desired position on the support element 1 for the play compensation element 9.

A compression spring 21, which is constructed as a so-called "lost-motion spring", completely encloses the inner element 5 in this embodiment. The inner element 5 has a spring plate 22 in the area of the head 6, against which the compression spring 21 rests with its one end 23. This spring plate 22 consists of a thin-walled sheet metal material, which on its outer edge 24 makes a transition into a ring collar 25 that runs orthogonally to the spring plate 22. Through this ring collar 25, the inner element 5 is conducted lengthwise in a corresponding diameter section of the receptacle 2. As can be recognized, the spring plate 22 is connected here via a simple snap connection 26 to the inner element 5 in a locationally fixed manner.

In the area of its other end 27, the compression spring 21 lies on the ring support 16. This ring support 16 is affixed to the housing 4. By the aforementioned construction, when uncoupled, the inner element 5 can keep the finger lever constantly in tappet contact when the tappet side recedes. In the manner in which the compression spring 21, as opposed to the former state of the art, is nested with the inner element according to the invention, a relatively low constructive support element 1 was created. The disadvantages mentioned in the introduction of the description, such as construction space problems, no longer occur. Especially when the support element 1 is provided with the hydraulic play compensation element 9, the measures proposed according to the invention prove to be sensible.

The receptacle 2 in the cylinder head 3 is indeed manufactured, according to the embodiment in the drawing, with in total three graduations. However, at the same time, a two-graduation construction or generally a multiple graduation is provided. It has its greatest diameter in its upper region for the outer edge 24 of the spring plate 22. It has a middle diameter in the area of an outer sheath 28 of the ring support 16. It has the smallest diameter in the lower area of the housing 4. Thus, the support element 1 is firmly attached in the cylinder head 3 and on the other hand, it is in a position to receive, during the operation of the valve drive, transverse forces that are introduced into the drive.

As is shown in FIG. 2, the spring plate 22 can also be constructed like a washer. Since in an aluminum cylinder head, in particular, when using the support element 1, problems of wear can occur, it is proposed to protect the corresponding contact area of the outer edge 24 of the spring plate 22 to the cylinder head 3 from wear via a separate insert piece 30.

LIST OF REFERENCE NUMBERS

1 Support element
2 Receptacle
3 Cylinder head
4 Housing
5 Inner element
6 Head
7 Second facing side
8 First facing side
9 Hydraulic play compensation element
10 Pressure piston
11 Bore
12 Coupling piston
13 Compression spring
14 Bore
15 Path
16 Ring support
17 Locking piston
18 Opening
19 Longitudinal groove
20 Path

21 Compression spring
22 Spring plate
23 One end
24 Outer edge
25 Ring collar
26 Snap connection
27 Other end
28 Outer sheath
29 Connection bore
30 Insert piece

What is claimed is:

1. Engaging and disengaging support element (1) for a finger lever of a valve drive of an internal combustion engine, comprising a hollow cylindrical housing (4) arranged with a first facing side (8) in a receptacle (2) of a cylinder head (3), the housing having a bore with an axially movable inner element (5) located therein, which is spring-loaded against the housing (4) via at least one compression spring (21), a piston having a head (6) that projects beyond a second facing side (7) of the housing (4) adapted to support the finger lever, the housing (4) and the inner element (5) each have at least one bore hole (14, 11), the bore holes (14, 11) are aligned with each other in an axial displacement of the inner element (5) to a position furthest from the first facing side (8), a coupling piston (12) is movably located in at least one of the bore holes (14, 11) and is displaceable into the other bore hole (11, 14) so that the inner element (5) is connected to the housing (4), the compression spring (21) concentrically surrounds at least the largest part of the inner element (5), the compression spring (21) is supported against a spring plate (22) on a first end (23) that faces the head (6), the spring plate (21) being attached near the head (6) on the inner element (5), and the compression spring (21) on its other end (27) that faces away from the head (6), acts against a ring support (16), which is attached to the housing (4).

2. Support element according to claim 1, wherein the spring plate (22) is manufactured as a thin-walled sheet metal part.

3. Support element according to claim 1, wherein the spring plate (22) is constructed as a single part with the inner element (5).

4. Support element according to claim 1, wherein the spring plate (22) has an outer edge (24) with a ring collar (25) located thereon that extends orthogonally to the edge, via which it is arranged in the receptacle (2) of the cylinder head (3) so that it can slide.

5. Support element according to claim 1, wherein the spring plate (22) is guided via an outer edge (24) thereof in the receptacle (2) of the cylinder head (3).

6. Support element according to claim 5, wherein the receptacle (2) of the cylinder head (3) has at least in an axial movement range of the inner element (5), an insertion piece (30) that is wear-proof, as an immediate sliding partner for the outer edge (24) of the spring plate (22).

7. Support element according to claim 1, wherein the ring support (16) is positioned axially at a height of the bore (14) of the housing (4) for the coupling piston (12) and surrounds it, whereby the coupling piston (12) extends in the bore (11) of the inner element (5), in the uncoupled state of the inner element (5) from the housing (4), and the bore (14) of the housing (4) for the coupling piston (12) is aligned with a connection bore (29) in the ring support (16) for the coupling piston (12).

8. Support element according to claim 1, wherein extending between the inner element (5) and the housing (4) is a locking piston (17) which extends from the ring support (16) radially inwardly through an opening (18) of the housing (4) into a longitudinal groove (19) on the inner element (5).

9. Support element according to claim 1, wherein at least one of the structural components of the housing (4), inner element (5), spring plate (22), or ring support (16), is made from a thin-walled sheet metal material or lightweight material manufactured by a non-cutting process.

10. Support element according to claim 1, wherein at least one of the elements spring plate (22) or ring support (16) is connected through a connection type made in the form of a snap, welded, soldered, or pressed connection (26) or by an axial attachment such as an attachment ring, to the inner element (5) or the housing (4).

11. Support element according to claim 1, wherein the receptacle (2) of the cylinder head (3) has three diameter graduations that increase in the direction towards its opening, whereby in the smallest graduation, an area of the first facing side (8) of the housing (4) is located, in the middle graduation, an outer sheath (28) of the ring support (16) is located, and in the largest graduation, an outer wall (24) of the spring plate (22) is located.

12. Engaging and disengaging support element (1) for a finger lever of a valve drive of an internal combustion engine, comprising a hollow cylindrical housing (4) arranged with a first facing side (8) in a receptacle (2) of a cylinder head (3), the housing having a bore with an axially movable inner element (5) located therein, which is spring-loaded against the housing (4) via at least one compression spring (21), a piston having a head (6) that projects beyond a second facing side (7) of the housing (4) adapted to support the finger lever, the housing (4) and the inner element (5) each have at least one bore hole (14, 11), the bore holes (14, 11) are aligned with each other in an axial displacement of the inner element (5) to a position furthest from the first facing side (8), a coupling piston (12) is movably located in at least one of the bore holes (14, 11) and is displaceable into the other bore hole (11, 14) so that the inner element (5) is connected to the housing (4), the compression spring (21) concentrically surrounds at least the largest part of the inner element (5), a hydraulic play compensation element (9) is installed in the inner element (5), and the head (6) is a component of a pressure piston (10) of the play compensation element (9).

13. Support element according to claim 12, wherein the bore (11) for the coupling piston (12) is positioned in the inner element (5) axially beneath the play compensation component (9).

14. Support element according to claim 12, wherein starting from two separate supply lines for hydraulic medium to the receptacle (2) of the cylinder head (3), separate hydraulic paths (20, 15) lead to the play compensation component (9) and to the coupling piston (12) in the support element (1).

* * * * *